US010696059B2

(12) United States Patent
Ohnishi

(10) Patent No.: US 10,696,059 B2
(45) Date of Patent: Jun. 30, 2020

(54) PRINTING APPARATUS AND PRINTING METHOD

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/954,607

(22) Filed: Apr. 17, 2018

(65) Prior Publication Data

US 2018/0311969 A1 Nov. 1, 2018

(30) Foreign Application Priority Data

Apr. 27, 2017 (JP) ..... 2017-088016

(51) Int. Cl.
*B41J 2/21* (2006.01)
*B41J 3/407* (2006.01)
*D06P 5/30* (2006.01)

(52) U.S. Cl.
CPC ..... *B41J 2/2103* (2013.01); *B41J 2/21* (2013.01); *B41J 2/2132* (2013.01); *B41J 3/407* (2013.01); *B41J 3/4078* (2013.01); *D06P 5/30* (2013.01)

(58) Field of Classification Search
CPC ... B41J 11/002; B41J 29/38; B41J 2/01; B41J 2/21; B41J 2/2103; B41J 2/2132; B41J 3/407; B41J 3/4078
USPC ..... 347/6, 15, 95, 100, 102
See application file for complete search history.

(56) References Cited

U.S. PATENT DOCUMENTS

2010/0177152 A1* 7/2010 Fukui ..... B41J 2/14233 347/104
2014/0347423 A1* 11/2014 Ohnishi ..... B41J 2/2103 347/43
2015/0251452 A1* 9/2015 Hatanaka ..... B41J 11/002 347/102

FOREIGN PATENT DOCUMENTS

JP 2015013455 1/2015

* cited by examiner

*Primary Examiner* — Jannelle M Lebron
(74) *Attorney, Agent, or Firm* — JCIPRNET

(57) ABSTRACT

A printing apparatus is provided that prints a print target on a medium made of chemical fiber fabric. The printing apparatus includes inkjet heads which are chromatic color heads that eject inks having chromatic colors, and an inkjet head which is a black color head that ejects ink having black color. The inks ejected from these inkjet heads are allowed to dry by evaporation and each contain a solvent and a coloring material for expressing the ink color. The inks are dried by evaporating the solvents in the inks to be fixed to the medium. The chromatic color heads include at least six or more inkjet heads that respectively eject the inks having chromatic colors distinct from each other.

15 Claims, 8 Drawing Sheets

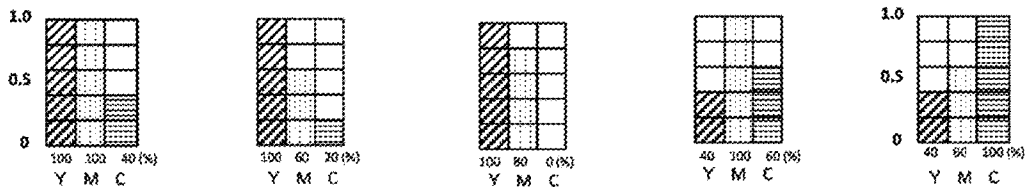

FIG. 8A

| COLOR SEPARATION PROCESS / ORIGINAL DATA | THREE COLOR SEPARATION PROCESS: IN-LINE MAXIMUM INK AMOUNT | | | FOUR COLOR SEPARATION PROCESS: IN-LINE MAXIMUM INK AMOUNT | | | SEVEN COLOR SEPARATION PROCESS: IN-LINE MAXIMUM INK AMOUNT | | | 13 COLOR SEPARATION PROCESS: IN-LINE MAXIMUM INK AMOUNT | | |
|---|---|---|---|---|---|---|---|---|---|---|---|---|
| | ALIGNED ARRANGEMENT | PER-COLOR GROUP ARRANGEMENT | | ALIGNED ARRANGEMENT | PER-COLOR GROUP ARRANGEMENT | | ALIGNED ARRANGEMENT | PER-COLOR GROUP ARRANGEMENT | | ALIGNED ARRANGEMENT | PER-COLOR GROUP ARRANGEMENT | |
| EXAMPLE A | 240 | 100 | Y: 100<br>M: 100<br>C: 40 | 160 | 60 | Y: 60<br>M: 60<br>C: 0<br>K: 40 | 100 | 60 | Y: 0<br>R: 60<br>K: 40 | 100 | 60 | Y: 0<br>R: 60<br>K: 40 |
| EXAMPLE B | 180 | 100 | Y: 100<br>M: 60<br>C: 20 | 140 | 80 | Y: 80<br>M: 40<br>C: 0<br>K: 20 | 100 | 40 | Y: 40<br>R: 40<br>K: 20 | 60 | 40 | YR: 40<br>K: 20 |
| EXAMPLE C | 180 | 100 | Y: 100<br>M: 80<br>C: 0 | 180 | 100 | Y: 100<br>M: 80<br>C: 0<br>K: 0 | 100 | 80 | Y: 20<br>R: 80<br>K: 0 | 80 | 60 | YR: 20<br>R: 60 |
| EXAMPLE D | 200 | 100 | Y: 40<br>M: 100<br>C: 60 | 120 | 60 | Y: 0<br>M: 60<br>C: 20<br>K: 40 | 100 | 40 | M: 40<br>B: 20<br>K: 40 | 80 | 40 | M: 20<br>BC: 20<br>K: 40 |
| EXAMPLE E | 200 | 100 | Y: 40<br>M: 60<br>C: 100 | 120 | 60 | Y: 0<br>M: 20<br>C: 60<br>K: 40 | 60 | 40 | B: 20<br>K: 40 | 80 | 40 | C: 20<br>CB: 20<br>K: 40 |

FIG. 8B

PRINTING APPARATUS AND PRINTING METHOD

CROSS REFERENCE TO RELATED APPLICATIONS

This application claims the priority benefit of Japanese Patent Application No. 2017-088016, filed on Apr. 27, 2017. The entirety of the above-mentioned patent application is hereby incorporated by reference herein and made a part of this specification.

TECHNICAL FIELD

This disclosure relates to a printing apparatus and a printing method.

DESCRIPTION OF THE BACKGROUND ART

Conventionally, inkjet printers that perform inkjet printing are used for various purposes (for example, Japanese Unexamined Patent Publication No. 2015-13455). It is discussed in recent years to use the inkjet printers for a broader range of industrial and other applications.

Patent Literature: Japanese Unexamined Patent Publication No. 2015-13455

To further diversify the areas to which the inkjet printers are applicable, types of media and inks desirably used need to be decided in accordance with printing qualities demanded in different areas of use. In this regard, the inventor has looked into cases in which the use of chemical fiber fabrics may be desirable for printed matters installed outdoors, like banners.

To be more specific, media used to produce such printed matters, like banners, may desirably be inexpensive and more water-resistant. Examples of such media may include taffeta made by weaving polyester fiber. In fact, banners, for example, are actually produced by using inkjet printers and media made of chemical fiber fabrics, in which case sublimation transfer printing is conventionally employed to print objects to be printed on such media.

SUMMARY

The sublimation transfer printing, however, requires an additional transfer step subsequent to the printing step, thus resulting in more steps before a printed matter is finally obtained. Another issue is the need to prepare an apparatus for transfer. This may involve cost increase and area increase for installation of such an additional apparatus. Depending on areas of use of such printed matters, higher weather resistance may be required than expected in sublimation transfer printing. This disclosure provides a printing apparatus and a printing method that may address the issues and fulfill the needs.

The inventor has studied how to improve the printability of media made of chemical fiber fabrics. The inventor, instead of discussing details of the sublimation transfer printing, has studied effective methods for direct printing with print media used.

Examples of the known inks usable with different types of media may include ultraviolet-curable inks (UV inks). The ultraviolet-curable inks may be expected to enable direct printing with chemical fiber fabrics using inkjet printers. The ultraviolet-curable inks, however, may often result in matte printing quality because of their ink properties. Further, the ultraviolet-curable inks may thicken ink layers and thereby compromise the original soft textures of fabrics. For certain printing purposes, other inks may desirably be used, instead of the ultraviolet-curable inks.

The inventor has discussed printing methods more apt for chemical fiber fabrics when ink allowed to dry by evaporation is used instead of the ultraviolet-curable inks. This ink is allowed to dry by evaporating a solvent in the ink and thereby fixed to a medium. In addition, the inventor has addressed the issue of ink bleeding more likely to occur when such an ink and fabric are used in combination.

Focusing on the issue, the inventor has conducted various tests to discuss a relationship between the amount of ink ejected per unit area of a medium and the occurrence of ink bleeding. The obtained results have revealed the finding the occurrence of ink bleeding may be adequately suppressed by using an increased number of different color inks. When, for example, the medium of chemical fiber fabric is a medium of polyester fabric (such as taffeta or tropical fabric), the occurrence of ink bleeding in practical use may be suppressed by using inks of seven or more different colors including yellow (Y), magenta (M), cyan (C), red (R), green (G), blue (B), and black (K).

Further keen studies by the inventor has led them to find features required to suppress the occurrence of ink bleeding. Then, the inventor has finally accomplished technical configurations disclosed herein. This disclosure provides a printing apparatus for printing a print target on a medium made of chemical fiber fabric. The printing apparatus includes a plurality of chromatic color heads which are inkjet heads that eject inks having chromatic colors, and a black color head which is an inkjet head that ejects ink having black color. The inks ejected from the chromatic color heads and the black color head are allowed to dry by evaporation and each contain a solvent and a coloring material for expressing the color of the ink. These inks are dried by evaporating the solvents in the inks to be fixed to the medium. The chromatic color heads include at least six or more inkjet heads that respectively eject the inks having chromatic colors distinct from each other.

When variously different colors are to be expressed by the printing apparatus thus characterized, ink amount ejected per unit area of the medium may be adequately decreased as compared to the use of Y, M, C, and K four color inks alone. This may suppress the occurrence of ink bleeding when the ink allowed to dry by evaporation is used with media of chemical fiber fabrics in which ink bleeding is more likely to occur. Then, the printability of media made of chemical fiber fabrics may be favorably improved.

When the medium used is a medium made of chemical fiber fabric, ink hardly absorbed by fiber is likely to run and spread along filaments of fiber. Thus, ink bleeding is more likely to occur than, for example, natural fiber fabrics and film media. On the other hand, the occurrence of ink bleeding may be adequately suppressed with chemical fiber fabrics by using seven or more color inkjet heads including six or more chromatic color heads and black color head.

Examples of the chemical fiber fabric may include tropical fabric and taffeta made by weaving polyester fiber. An example of the chemical fiber may be polyester fiber. The medium of chemical fiber fabric may be directly used without any pretreatment as a preventive measure against ink bleeding. This may favorably avoid cost increase of the medium. Yet, the occurrence of ink bleeding may be adequately suppressed by using seven or more color inkjet heads.

The chromatic color heads preferably include at least inkjet heads for first-order colors and inkjet heads for second-order colors. The first-order colors described herein may be basic colors that allow full colors to be theoretically expressed by color mixing. The second-order colors described herein may be colors obtained by mixing two of the first-order colors. The first-order color heads preferably include at least inkjet heads for yellow (Y), magenta (M), and cyan (C) colors. The second-order color heads preferably include at least inkjet heads for red (R), green (G), and blue (B). When, for example, inks having two colors selected from the three first-order colors are mixed in equal amount to express a color, the color obtained may be theoretically equal to and replaceable with the color of any one of the inks having second-order colors in an amount equal to the inks having two colors. When the ink having the black color is assumed to be ink having a third-order color, a color obtained by mixing all of the inks having the first-order colors in equal amount is theoretically equal to and replaceable with the color of the ink having the third-order color in an amount equivalent to the equal amount. Thus, the first-order color inks mixed in equal amount may be replaceable with a second-order color ink in an amount equivalent to the equal amount. This may adequately decrease ink consumption for printing. This may also suppress the occurrence of ink bleeding and offer a colorful and vivid printing performance.

The printing apparatus may be a serial printing apparatus that causes the inkjet heads to perform main scans. The printing apparatus may further include a main scan driver and a sub scan driver that respectively cause the inkjet heads to perform main scans and sub scans. The printing apparatus further including these configurations may carry out the printing operation as desired by using seven or more color inkjet heads.

The printing apparatus may further include a heater that heats the medium. By providing the heater, the inks ejected may be dried in short time. In this instance, the heater may be set to low heating temperatures. Yet, the occurrence of ink bleeding may be adequately suppressed by using seven or more color inkjet heads. The medium may be heated at, for example, temperatures lower than or equal to 50° C. Such low temperatures of the heater may adequately prevent that nozzles of the inkjet heads are thermally clogged with inks while the medium is being heated. The medium is preferably heated at even lower temperatures, for example, temperatures lower than or equal to 40° C. Heating the medium using the heater then may be aimed at having the medium stay at constant temperatures to suppress any adverse impacts from environmental temperature, rather than aggressively heating the inks on the medium to higher temperatures. Therefore, the heater may be unnecessary depending on demanded printing quality and/or selected printing environment.

The printing apparatus thus characterized may print a print object on the medium to produce a printed matter installed outdoors. Examples of such a printed matter may include banners. By using media made of chemical fiber fabrics such as taffeta, printed matters that excel in weather resistance may be obtained at low cost.

In this instance, ink containing a pigment as coloring material may be suitably used. By using the ink thus characterized, the printed matter may be further improved in weather resistance. Examples of the ink allowed to dry by evaporation used in this instance may include latex inks. The latex ink may further improve the printed matter in weather resistance.

The latex ink containing a resin component having tendency to agglutinate may be more effectively increased in viscosity than, for example, solvent inks, in an early stage where the solvent is yet to be sufficiently evaporated. The latex ink thus characterized may adequately suppress the occurrence of ink bleeding. The latex ink less likely to bleed may be favorably used when, for example, the medium is heated by the heater at low temperatures or the heater is not used at all. When such a latex ink is used and heated by the heater, for example, the heating temperature for the medium may be, for example, lower than 50° C. or preferably lower than 40° C.

This disclosure may further present a printing method having technical features that are equivalent to those of the printing apparatus. Such a printing method may obtain similar effects. This printing method may be configured as a manufacturing method for printed matter.

As disclosed herein, the printability of media made of chemical fiber fabrics may be favorably improved.

BRIEF DESCRIPTION OF THE DRAWINGS

FIG. 1A is a plan view of the printing apparatus, illustrating its main structural elements by way of example. FIG. 1B illustrates a head portion of the printing apparatus by way of example.

FIG. 4A illustrates the principle of color reproducibility in 4 color separation process. FIG. 4B illustrates color reproducibility when inks for practical use are used to express R color by mixing Y color ink and M color ink.

FIG. 5A illustrates a modified example of the head portion. FIG. 5B illustrates another modified example of the head portion.

FIG. 7A illustrates a model that illustrates color correlation among colors of inks used in the modified example. FIG. 7B illustrates an example of the head portion in the modified example.

FIGS. 8A and 8B illustrate ink total amounts required to express variously different colors. FIG. 8A illustrates examples of colors that can be expressed in full-color printing. FIG. 8B illustrates amounts of color inks required to express colors in examples A to E illustrated in FIG. 8A, and a total amount of inks ejected to the same position in each main scan when the number of printing colors and the arrangement of inkjet heads are variously changed.

DETAILED DESCRIPTION OF EMBODIMENT

Figure 1A:
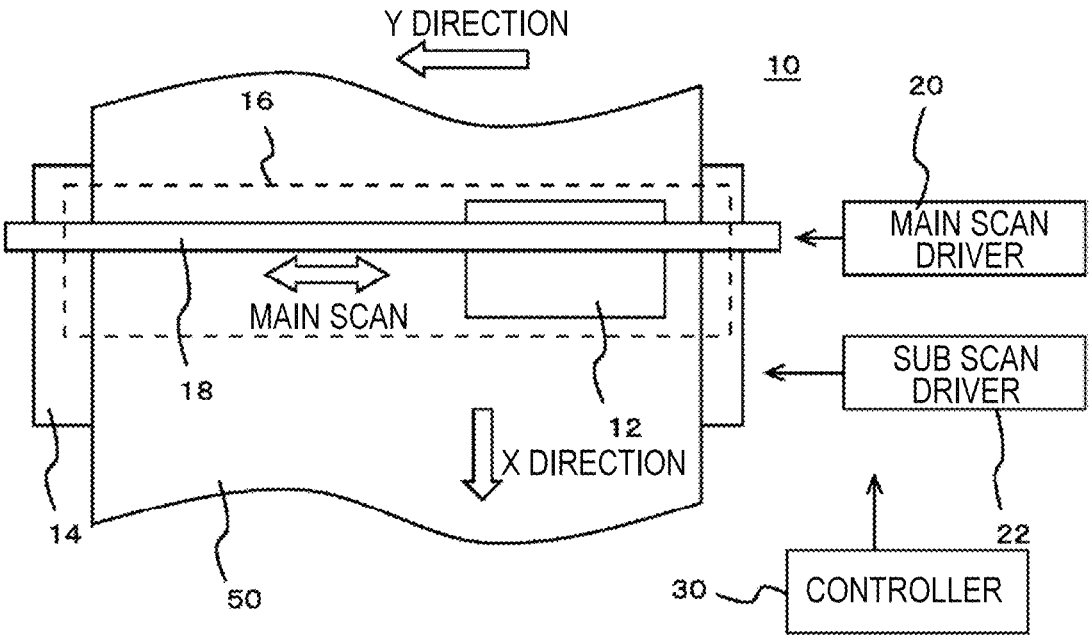
FIGS. 1A and 1B illustrate a printing apparatus according to an embodiment of this disclosure.
Figure 1B:
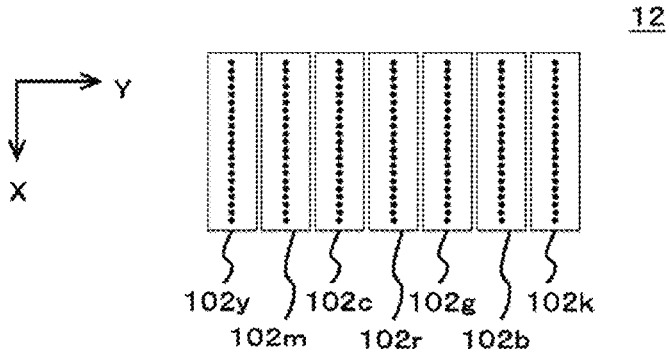

Hereinafter, embodiments of this disclosure are described in detail with reference to the accompanying drawings. FIGS. 1A and 1B illustrate a printing apparatus 10 according to an embodiment. FIG. 1A is a plan view of the printing apparatus 10, illustrating its main structural elements by way of example. FIG. 1B illustrates a head portion 12 of the printing apparatus 10 by way of example. Except for aspects hereinafter described, the printing apparatus 10 is configured identically or similarly to the known inkjet printing apparatuses (inkjet printers). The printing apparatus 10 may include any configurations or features required of its printing operation in addition to the main structural elements illustrated in FIG. 1A.

In this embodiment, the printing apparatus 10 is an inkjet printer that prints a print object on a medium 50 which is a chemical fiber fabric, and carries out color printing (for example, full-color printing) for the medium 50 using inks having a plurality of different colors. The medium 50 used in the printing apparatus 10 will be described later in further detail. The printing apparatus 10 described in this embodiment is a serial printing apparatus that causes inkjet heads to perform main scans. The main scan described herein refers to an operation in which the inkjet head ejects ink while moving relative to the medium 50 in a main scanning direction (Y direction) previously set.

For this operation, the printing apparatus 10 includes a head portion 12, a platen 14, a heater 16, a guide rail 18, a main scan driver 20, a sub scan driver 22, and a controller 30. The head portion 12 is an ink ejecting portion provided to eject inks toward the medium 50. The head portion 12 includes a plurality of inkjet heads that respectively eject inks having different colors. In this instance the ink ejected from the inkjet head is liquid droplets (ink droplets) ejected by inkjet printing. In this embodiment, the inkjet heads of the head portion 12 are, as illustrated in the figure, an inkjet head 102*y*, an inkjet head 102*m*, an inkjet head 102*c*, an inkjet head 102*r*, an inkjet head 102*g*, an inkjet head 102*b*, and an inkjet head 102*k* (hereinafter, may be collectively referred to as inkjet heads 102*y-k*). As illustrated in the figure, the inkjet heads 102*y-k* are arranged in the main scanning direction (Y direction) in positional alignment with one another in a sub scanning direction orthogonal to the main scanning direction (X direction). The inkjet heads 102*y-k* each have a nozzle array in which a plurality of nozzles are aligned in a predetermined direction. In this embodiment, the predetermined direction of the nozzle array is parallel to the sub scanning direction.

Of these inkjet heads, the inkjet head 102*y* ejects a Y (yellow) color ink. The inkjet head 102*m* ejects an M (magenta) color ink. The inkjet head 102*c* ejects a C (cyan) color ink. The inkjet head 102*r* ejects R (red) color ink. The inkjet head 102*g* ejects G (green) color ink. The inkjet head 102*b* ejects B (blue) color ink. The inkjet head 102*k* ejects K (black) color ink.

All of the inkjet heads 102 but the inkjet head 102*k* (hereinafter, may be referred to as inkjet heads 102*y-b*) are each an example of the chromatic color head, which is the inkjet head that ejects a chromatic color ink. Thus, the printing apparatus 10 in this embodiment may be configured as having six chromatic color heads that eject color inks respectively having different chromatic colors. In a modified example, the printing apparatus 10 may have more than six chromatic color heads. The inkjet head 102*k* is an example of the black color head, which is the inkjet head that ejects black ink.

In the fields pertinent to inkjet printers, Y, M, C, and K four color inks alone may be mostly used for color printing, unlike this embodiment using seven color inks. Variously different colors can be expressed by differently combining the Y, M, and C three color inks. In color printing using an inkjet printer, the Y, M, and C three colors may be defined as first-order colors which are basic colors that allow full colors to be expressed by color mixing. In this embodiment, full color expression may be theoretically feasible by using the Y, M, and C three color inks among the six color inks ejected from the inkjet heads 102*y-b*. In this embodiment, therefore, the Y, M, and C three colors may be defined as first-order color inks. Further, R, G, and B three colors can be expressed by mixing two colors selected from the first-order colors, which are Y, M, and C three colors. Of the six color inks ejected from the inkjet heads 102*y-b*, the R, G, and B three color inks may be defined as second-order color inks obtained by mixing two of the first-order color inks. The Y, M, and C three colors or the R, G, and B three colors may be theoretically mixed into K color. In this embodiment, therefore, the ink ejected from the inkjet head 102*k* may be defined as a third-order color ink.

By classification, the colors of inks used in this embodiment may be considered to include seven or more colors including at least three first-order colors, at least three second-order colors, and a third-order color that allow for full color expression. Each second-order color may be theoretically the same color as a color obtained by mixing two of the first-order colors. The third-order color may be theoretically the same color as a color obtained by mixing the three first-order colors.

In this embodiment, inks allowed to dry by evaporation are used for the inkjet heads 102*y-k*. The ink allowed to dry by evaporation described herein specifically refers to ink dried by evaporating a solvent in the ink to be fixed to the medium 50. This ink may contain a solvent and a coloring material for expressing the ink color. The solvent may be a liquid in which the coloring material is dispersible or dissoluble. The inks ejected from the inkjet heads 102*y-k* are all substantially the same ink, except coloring materials used therein. Specifically, the inks being substantially the same ink except their coloring materials may be configured that the inks are substantially equal in composition, except any materials added for compositional adjustments in accordance with their different coloring materials.

Examples of the ink allowed to dry by evaporation include aqueous inks, solvent inks, and solvent UV inks. The solvent UV ink may be UV ink diluted with a solvent. The ink used in this embodiment is, for example, aqueous latex ink which is an example of aqueous inks. The latex ink contains a solvent and a polymer including a resin component and is dried to fix the polymer to the medium 50. The polymer included in the aqueous latex ink may be an aqueous polymer. The polymer may be a gummy polymer. The latex ink may improve the weather resistance of a printed matter. In this embodiment, the coloring material included in the ink is a pigment, so that a printed matter may be further improved in weather resistance.

The platen 14 is a table-like member that supports the medium 50. The medium 50 is mounted on and supported by the upper surface of the platen 14 at a position at which the medium 50 faces the head portion 12. In this embodiment, the platen 14 is embedded with a heater 16 that heats the medium 50. The heater 16 is a printing heater that heats the medium 50 at a position at which the heater 16 faces the head portion 12 across the medium 50. In a modified example, the printing apparatus 10 may be equipped with an optional heater other than the printing heater. Examples of the other heater may include a pre-heater that heats the medium 50 at a position more upstream than the head portion 12 in a direction in which the medium 50 is transported, and an after-heater that heats the medium 50 at a position more downstream than the head portion 12 in the transport direction of the medium 50.

The ink allowed to dry by evaporation used in this embodiment may be dried in short time by having the medium 50 heated by the heater 16. To prevent the occurrence of ink bleeding, the ink is preferably heated at higher temperatures to be dried with less time. When the medium 50 is heated at overly high temperatures, the inkjet heads of the head portion 12 may be thermally affected, which may increase the risk of nozzle clogging. The heating temperature of the heater 16 is preferably as low as possible within a range of temperatures at which the risk of ink bleeding may be minimized.

In this regard, this embodiment uses seven color inks to ensure that ink bleeding is less likely to occur, as described later in further detail. The medium 50 may be heated by the heater 16 at, for example, temperatures lower than or equal to 50° C. At such temperatures, the medium 50 may be adequately heated, with a reduced risk of nozzle clogging. The medium 50 is preferably heated at even lower temperatures lower than or equal to 40° C. (for example, approximately 25° C. to 40° C.). Heating the medium 50 using the heater 16 may be considered as heating aimed at having the medium 50 stay at certain temperatures to avoid any adverse impacts from environmental temperature, rather than aggressively heating the ink on the medium 50 to higher temperatures. Therefore, heating the medium 50 using the heater 16 may be unnecessary depending on demanded printing quality and/or printing environment.

The guide rail 18 guides the movement of the head portion 12 during main scans. The movement of the head portion 12 during main scans may be specifically the movement of the inkjet heads 102*y-k* of the head portion 12. For illustrative purposes, a carriage that holds the inkjet heads 102*y-k* is not illustrated in FIGS. 1A and 1B. The guide rail 18 may guide the carriage to guide the movement of the head portion 12.

The main scan driver 20 causes the inkjet heads 102*y-k* to perform main scans. Causing the inkjet heads 102*y-k* to perform main scans may be specifically causing the inkjet heads 102*y-k* to eject the inks based on printing data representing an image to be printed, while moving the inkjet heads 102*y-k* in the main scanning direction.

The sub scan driver 22 causes the inkjet heads 102*y-k* to perform sub scans. The sub scan described herein refers to an operation in which the inkjet heads move relative to the medium 50 in the sub scanning direction. In this embodiment, the sub scan driver 22 transports the medium 50 in the transport direction parallel to the sub scanning direction to cause the inkjet heads 102*y-k* to perform sub scans. The medium 50 is transported by a predetermined amount of feed at intervals between main scans, so that a region of the medium 50 facing the head portion 12 continues to change. The sub scan driver 22 transports the medium 50 by, for example, driving a roller not illustrated.

The printing apparatus 10 may be configured to carry out multi-pass printing. The multi-pass printing described herein may refer to a printing operation in which a plurality of main scans are performed at respective positions on the medium 50. In each sub scan, the medium 50 may be transported by, for example, an amount of feed decided by the number of passes. The amount of feed decided by the number of passes described herein may be an amount of feed corresponding to a width calculated by dividing the length of a nozzle array (length in the sub scanning direction) in each of the inkjet heads 102*y-k* by the number of passes.

The controller 30 may be the CPU of the printing apparatus 10 that controls the structural elements of the printing apparatus 10, so that the printing operation for the medium 50 is appropriately carried out.

The medium 50 used in the printing apparatus 10 is hereinafter described in further detail. As described earlier, the medium 50 used in this embodiment is a chemical fiber fabric. In the medium 50 made of chemical fiber fabric, the chemical fiber may be exposed on a print target surface of the medium. In the medium 50 with the chemical fiber being exposed on the print target surface, for example, ink makes direct contact with the chemical fiber, unlike any chemical fiber fabric with a film adhered to its surface to avoid direct contact between the ink and chemical fiber. As such chemical fiber, any fiber may be used that hardly absorbs ink such as polyester fiber.

The medium of chemical fiber fabric may likely to increase the risk of ink bleeding, as compared to other types of media. In the technical fields pertinent to inkjet printers, therefore, media, like the medium 50, are conventionally deemed difficult to use for printing, with a considerably reduced risk of ink bleeding. In the medium 50 of chemical fiber fabric, filaments of fiber that hardly absorb ink are intricately entangled with one another. Therefore, the ink that has landed on the medium 50 is likely to run and spread along the fiber filaments in different directions. When, for example, a film medium that also hardly absorbs ink is used instead of fabrics, ink may spread likewise on the medium but may stay on its print target surface. On such media, ink may only spread in a thus limited range, which may be easier to control than in fabric-made media. Other types of fabric-made media, for example, media of natural fiber fabrics have ink absorbability and may be unlikely to spread the ink, as compared to media of chemical fiber fabrics. Thus, it may be easier to suppress the occurrence of ink bleeding with such media than media of chemical fiber fabrics.

Among different types of media such as films, natural fiber fabrics, and chemical fiber fabrics, ink bleeding is far more likely to occur with media of chemical fiber fabrics than the other media. Due to these facts, media of chemical fiber fabrics, like the medium 50, are conventionally deemed difficult to use for printing, with a considerably reduced risk of ink bleeding. The inventor of this disclosure has been led to the finding through the tests, which using inks of seven colors including first-order, second-order, and third-order colors described earlier may adequately suppress the occurrence of ink bleeding when media of chemical fiber fabrics, such as the medium 50, are used as print media. Specifically, the occurrence of ink bleeding being adequately suppressed may be configured that a printing operation unlikely to cause ink bleeding may be feasible under conditions for practical use without overly downgrading resolution or printing speed.

In the case an exceptionally low resolution is set for printing using inkjet printers, ink bleeding may be unlikely to occur. Further, ink bleeding may be unlikely to occur in multi-pass printing with an exceptionally large number of passes. However, it is difficult say that these are reasonable printing conditions in practical use. Under conditions of 12 or less printing passes and 600 dpi or more printing resolutions, for example, it may be determined that ink bleeding is adequately suppressed when the extent of ink bleeding to be addressed does not occur at the set resolution. As described later in further detail, the tests conducted by the inventor demonstrate that the technical configurations disclosed herein may prevent the extent of ink bleeding to be addressed at resolutions greater than or equal to 900 dpi, and printing quality suitable for practical use may be obtained with, for example, 8 or less or 4 or less printing passes. This embodiment, therefore, may enable high-speed, high-quality printing with media of chemical fiber fabrics.

The occurrence of ink bleeding may be effectively suppressed by heating the medium 50 at high temperatures, which is, however, associated with the risk of nozzle clogging, as described earlier. In this embodiment, a desired printing performance may be feasible with a reduced risk of ink bleeding when the heating temperature for the medium 50 is lower than or equal to 50° C. or lower than or equal to 40° C. The occurrence of ink bleeding may be effectively suppressed by applying pretreatment to the medium 50 as a preventive measure against ink bleeding. This, however, may lead to large cost increase of the medium 50. In this embodiment, a desired printing performance may be feasible with a reduced risk of ink bleeding when the medium 50 of chemical fiber fabric is directly used without such bleeding-preventive pretreatment being applied.

Figure 2:
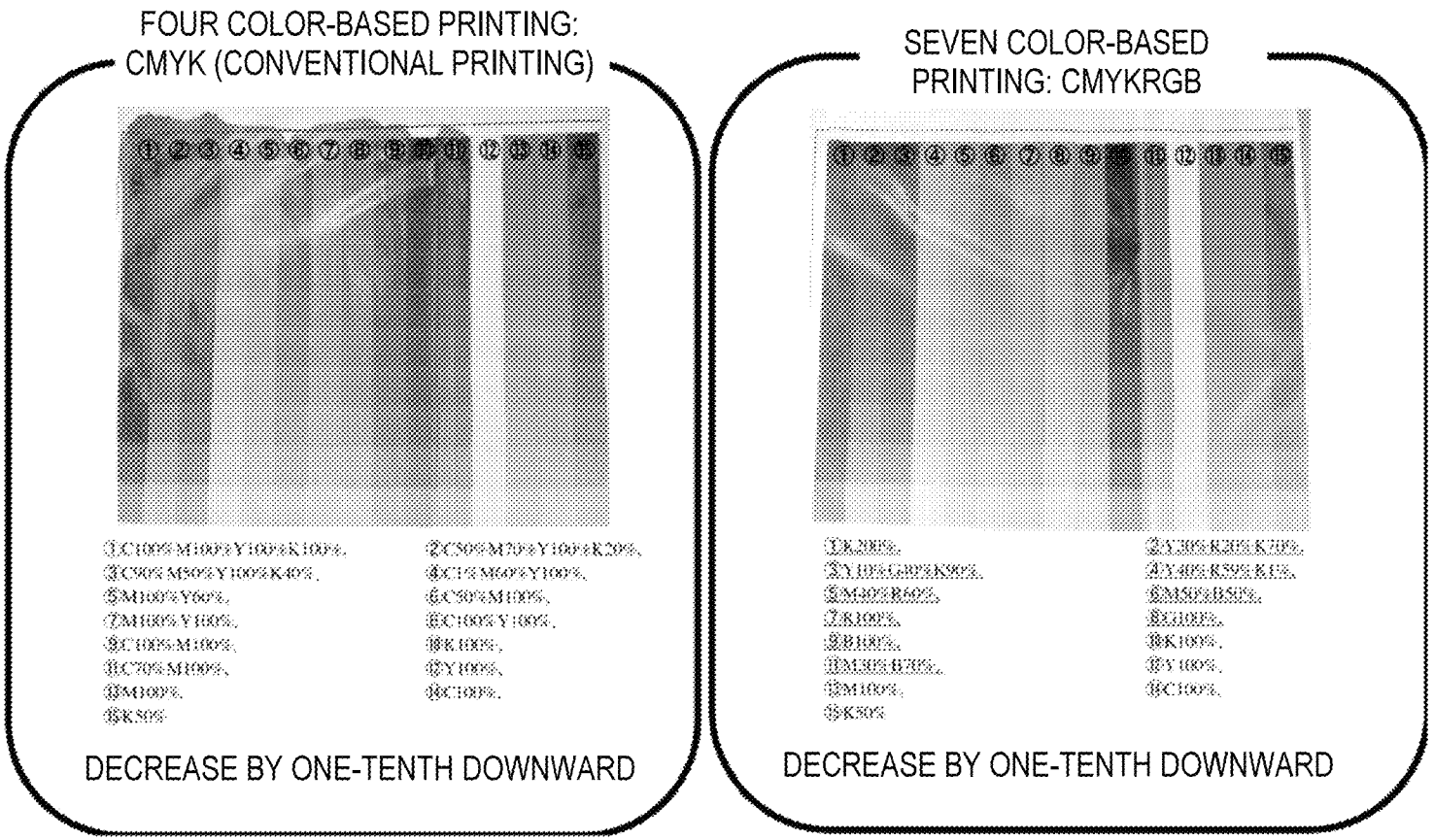
FIG. 2 illustrates test results in which a medium of chemical fiber fabric was taffeta.
Figure 3:
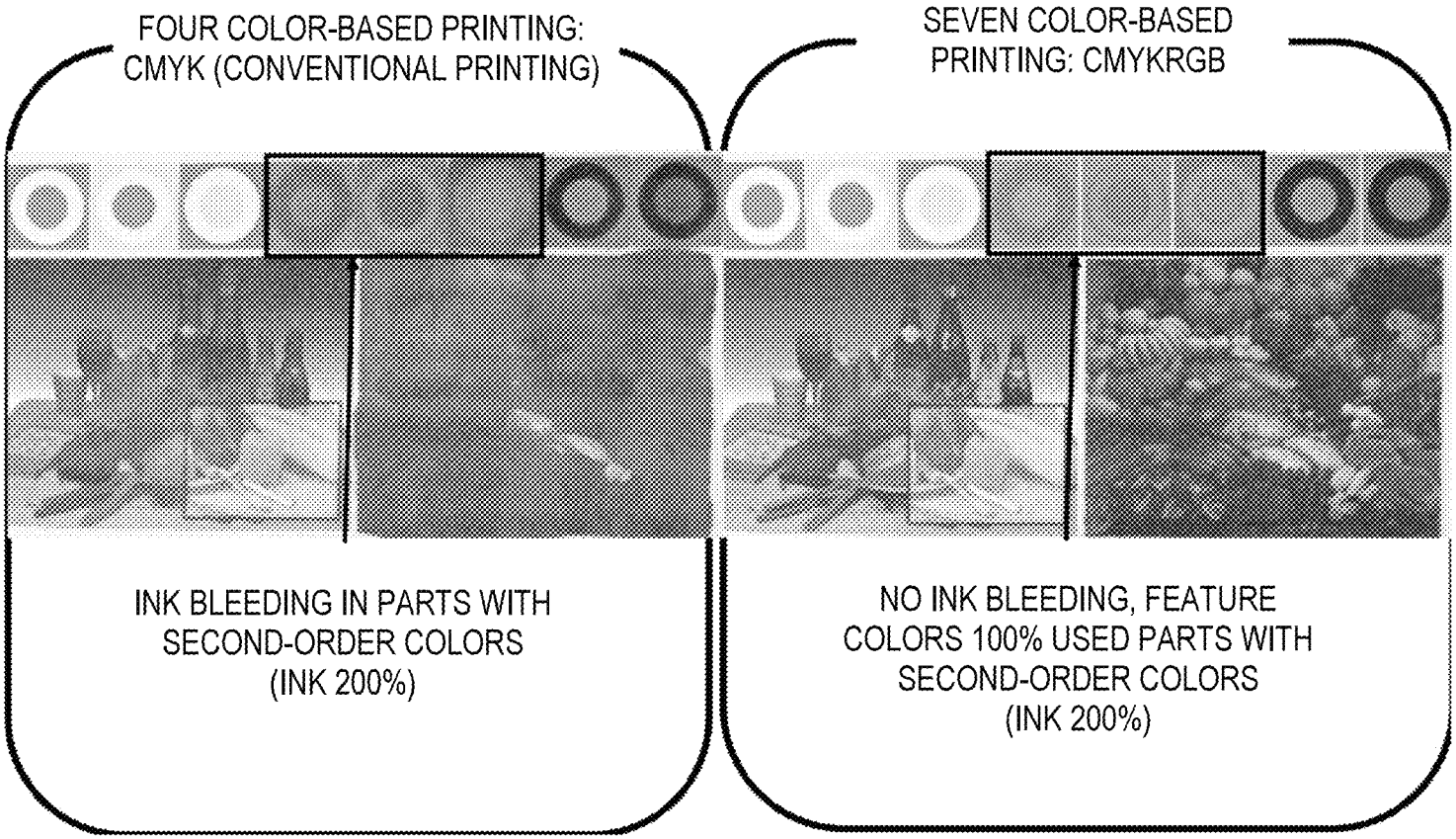
FIG. 3 illustrates test results in which the medium of chemical fiber fabric was tropical fabric.

The tests conducted by the inventor are hereinafter described in further detail. FIGS. 2 and 3 show part of the test results. While FIGS. 2 and 3 show print results in gray scale for illustrative purposes, color printing was actually performed in the tests with technical configurations required of full-color printing.

FIG. 2 illustrates test results in which the medium 50 of chemical fiber fabric was taffeta. The taffeta may refer to a plain weave fabric in which long raw silk yarns are densely interwoven. The taffeta may be considered to be a thin textile with a repped plain texture or a glossy, narrow-repped thin textile. The medium 50 used in the test was a medium of taffeta fabric woven with polyester fiber.

The printing apparatus used in the test was a known inkjet printer JV4006-130LX (registered trademark) supplied by MIMAKI ENGINEERING CO., LTD., which was modified in functions for printing control and adapted for the number of color inks used. The ink used in the test was a known pigment latex ink supplied by Hitachi Maxell, Ltd. Other conditions were printing resolution of 900×900 dpi, and multi-pass printing with 12 printing passes (12 passes). The medium 50 was heated by a heater in which the heating temperature was set to 30° C.

The print results illustrated with "4 color-based printing" are the print results obtained by using C, M, Y, and K (Y, M, C, and K) four color inks alone. The 4 color-based printing may be equivalent to the conventional technical configurations. The results illustrated with "7 color-based printing" are the results obtained by using C, M, Y, K, R, G, and B (Y, M, C, R, G, B, and K) seven color inks in a similar manner to or in the same manner as described referring to FIGS. 1A and 1B.

As for printing details, charts exhibiting various colors were printed with color inks at varying concentrations. The concentrations of color inks are specifically concentrations of color inks ejected per unit area. The concentrations of the inks ejected to all of ink-ejecting positions predetermined for the set resolution amount to the concentration of 100%. The printing resolution and printing concentration are set in a relationship that allows an enough overlap between adjacent ink dots formed by printing at the concentration of 100% so as to cover the whole surface of the medium 50.

Preset 15 different colors were printed in the test under conditions set for 4 color-based printing and conditions set for 7 color-based printing. The 15 different colors are shown in the figure with circled numbers 1 to 15. In print results by the 4 color-based printing and 7 color-based printing, colors with the same number are theoretically the same color. As illustrated in the figure, the 15 different colors were printed in the test at variously different concentrations decreased in increments of tenth.

As is known from the results of the figure, the 4 color-based printing resulted in considerably heavy ink bleeding, except some colors. This poor result indicates inadequacy for practical use. On the other hand, the 7 color-based printing resulted in a satisfactory print outcome without ink bleeding in any colors at any concentrations. According to this print result, the 7 color-based printing may be useful for practical use. Thus, the 7 color-based printing, without changing any other printing conditions, was proven to produce such a successful print result with the medium 50, in contrast to the conventional 4 color-based printing that caused heavy ink bleeding on the same medium 50.

As described in this embodiment, the 7 color-based printing may decrease the amount of inks ejected per unit area to produce various colors, as compared to the 4 color-based printing. This may suppress the risk of ink bleeding when the ink allowed to dry by evaporation is used with media of chemical fiber fabrics more likely to undergo ink bleeding, like the medium 50. The decrease of the amount of inks by the 7 color-based printing will be described later in further detail.

The chemical fiber fabrics, such as taffeta, used in the test hardly absorb liquid such as ink, as described earlier. When the medium 50 used is such a fabric, an obtained printed matter, if installed outdoors, may certainly not absorb liquid such as rain. Additionally, the chemical fiber fabrics made of, for example, polyester fiber may excel in weather resistance. According to this embodiment, therefore, a printed matter installable outdoors may be easily and desirably obtained by the 7 color-based printing with the medium 50 of chemical fiber fabric. Specific examples of such a printed matter possibly installed outdoors may include banners for advertising purposes.

In this instance, when the pigment-containing inks or latex ink is used, the ink adhered to the medium 50 may attain high weather resistance, as described earlier. This embodiment may thus provide printed matters that excel in weather resistance that may be used as banners. The latex ink containing a resin component having tendency to agglutinate may be more effectively increased in viscosity when fixed to the medium 50 than, for example, solvent inks, in an early stage where solvents are still not sufficiently evaporated. The latex ink thus characterized may adequately suppress the occurrence of ink bleeding. Therefore, the printability of the medium 50 may be improved when, for example, the medium 50 is heated by the heater at low temperatures or the heater is not used at all. In the test illustrated in FIG. 2, the medium 50 is heated by the heater at a low temperature (30° C.) to avoid any adverse impacts from environmental temperature. The printing conditions may be somewhat changed, and higher heating temperatures may be set in the heater. Yet, the medium 50 may be heated at temperatures lower than 50° C. or preferably lower than 40° C. In this embodiment, therefore, the occurrence of ink bleeding may be adequately suppressed, while the risk of nozzle clogging may be controlled at the same time.

This embodiment that uses the pigment-containing latex ink may dispense with the use of any coloring assistants or coloring treatments for color development of the inks after printing (steaming), unlike inks containing dyes as coloring material. This embodiment may accordingly enable full-color printing with the medium 50 of chemical fiber fabric, and may readily produce diverse banners uniquely designed.

The polyester fiber taffeta is a non-limiting example of the chemical fiber fabric used in the medium 50. FIG. 3 illustrates test results in which the medium 50 of chemical fiber fabric was tropical fabric. The tropical fabric is a worsted fabric that feels dry. The medium 50 used in this test was tropical fabric woven with polyester fiber.

The printing conditions of this test were partly changed from the conditions set for the test, results of which are shown in FIG. 2, because of different date and time of the test. The test, results of which are shown in FIG. 3, employed the multi-pass printing with 8 printing passes (8 passes). In this test, images like still-life painting were printed on the medium 50, instead of the monotonic pattern illustrated in FIG. 2. The 4 color-based printing and 7 color-based printing were carried out under the conditions otherwise similar to or the same as in the test described referring to FIG. 2.

In the result obtained by the 4 color-based printing, ink bleeding occurred in parts of second-order colors where concentrations of inks mixed for color expression in total was 200%. This result demonstrates that the 4 color-based printing has difficulty in obtaining a high-quality print result in which ink bleeding is adequately reduced.

In the 7 color-based printing, the occurrence of ink bleeding may be adequately suppressed in parts of second-order colors such as R, G, and B, probably because the ink concentrations in parts of second-order colors amount to 100% or less by using seven color inks. These results teach that, in this embodiment, a desired printing performance may be feasible in the medium 50 of polyester tropical fabric.

So far were described the test results obtained with media of polyester tropical fabric and taffeta to simplify the description. In addition to the tests described so far, the inventor compared print results obtained with various media 50 of different chemical fiber fabrics under different conditions by the 4 color-based printing and the 7 color-based printing. The results of the additional test demonstrate that the 7 color-based printing may dramatically reduce the occurrence of ink bleeding and succeed in a desired printing performance at a printing speed and with a printing quality suitable for practical use, although such success under such conditions may be difficult to achieve in the 4 color-based printing. These various tests conducted by the inventor reveal new potentials of fields to which inkjet printers are applicable and which are deemed difficult in the conventional 4 color-based printing, for example, successful production of banners having a great commercial significance.

Hereinafter, supplementary remarks are given in relation to the 7 color-based printing. As described earlier, the Y, M, C, and K four color inks are often used (hereinafter, may be referred to as 4 color separation process) in serial printing using inks each containing a pigment as coloring material (pigment ink). The inkjet heads for Y, M, C, and K colors are conventionally arranged in alignment next to one another in the main scanning direction.

In this embodiment, seven color inks in total, which are the Y, M, C, K, R, G, and B inks, are used for printing (hereinafter, may be referred to as 7 color separation process). This 7 color separation process is directed to obtaining a printing quality suitable for practical use by using media of chemical fiber fabrics such as polyester fiber. By using seven color inks, a colorful and vivid printing performance may be feasible with higher color reproducibility than in the 4 color separation process. First, this distinctive feature is described in further detail.

Figure 4A:
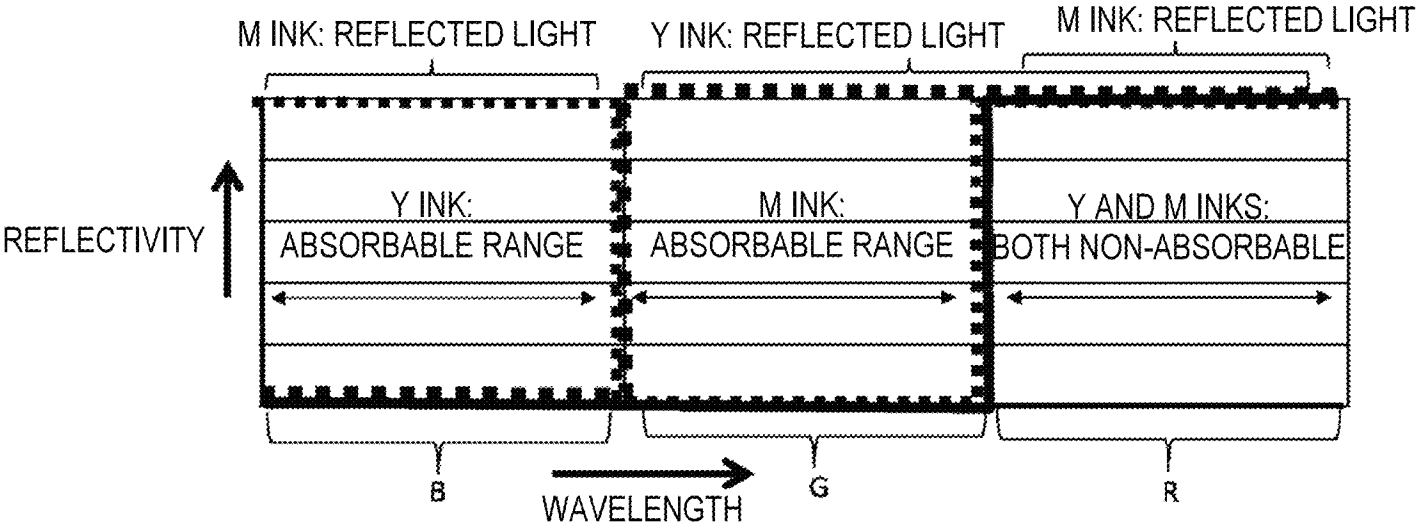
FIGS. 4A and 4B illustrate color reproducibility in 4 color separation process.
Figure 4B:
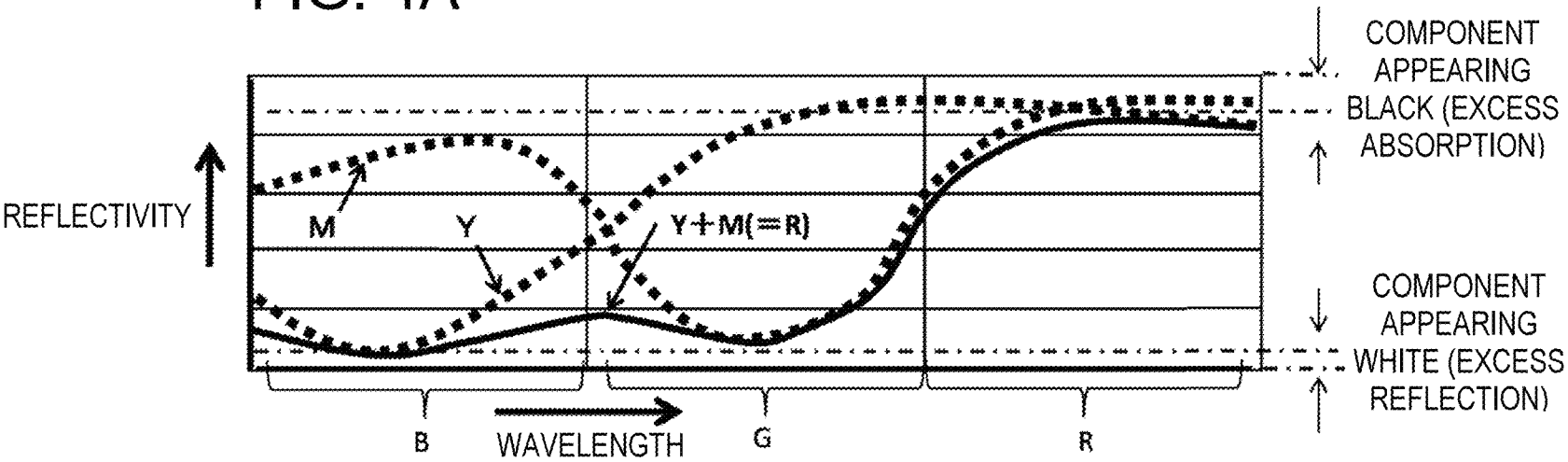

FIGS. 4A and 4B illustrate color reproducibility in the 4 color separation process. FIG. 4A illustrates the principle of color reproducibility in the 4 color separation process. This figure illustrates an example of color reproducibility when ideal inks are used, instead of inks for practical use, to produce R color by mixing Y and M color inks. FIG. 4B illustrates color reproducibility when inks for practical use are used to express R color by mixing Y and M color inks.

When ideal inks are used in the 4 color separation process, Y, M, and C color inks each completely reflect light in a certain range corresponding to each color, while completely absorbing light in the other range. Ideally, when each basic color is assumed to be 1, a color 1×R at the maximum concentration of red (R) is the sum of Y color and M color, which is expressed by the formula (1).

$$1R=1Y+1M(+0C) \quad \text{formula (1)}$$

Referring to a model illustrated in FIG. 4A, color mixing between ink having Y color of 1 representing 100% and ink having M color of 1 representing 100% results in absorption of, among three light components of R, G, and B, light components of G and B into the ink, leaving 1R component alone unabsorbed. Then, the formula becomes true, allowing red (R) color alone to be visually recognized.

However, coloring materials in the practical inks, such as pigments (coloring materials of Y, M, and C colors), may contain components reflected and absorbed in unnecessary portions, other than ideally reflected and absorbed components. When Y color ink and M color ink are mixed by the 4 color separation process, a reproduced color of red, R', is expressed by the formula (2).

$$R'=aY+bM(+\theta C)\neq 1R, \quad \text{formula (2)}$$

where a, b, θ is a positive number less than or equal to 1

Then, the Y and M components fail to be 1, resulting in tone reduction, or clouding may occur due to C component that the ideal inks do not contain. A similar phenomenon (clouded second-order color) occurs in color mixing of Y+C (=G), C+M (=B).

In the 7 color separation process according to this embodiment, R, G, and B colors may be expressed without mixing the other color inks, and a colorful and vivid printing performance may be feasible with higher color reproducibility than in the 4 color separation process.

Reduced ink consumption in the 7 color separation process is hereinafter described in comparison to the 4 color separation process. In the 4 color separation process, as indicated with the formula 1), ink of 100% Y color and ink of 100% R color are ejected to the same position, 200% in total, to express R color. To express the other second-order colors which are G color and B color, the respective inks are also ejected, 200% in total. In the 4 color separation process, the amount of inks ejected (per unit area) to express a second-order color (R, G, B) is twice of the amount to express a first-order color. In any parts to be colored with the second-order colors, therefore, ink consumption increases, leading to a high risk of ink bleeding. This may lead to difficulty in obtaining a printing quality suitable for practical use when, for example, media of chemical fiber fabrics are used.

Optionally, upper limits may be set for the amounts of Y, M, and C color inks used to express the second-order and third-order colors. For example, the inks ejected in total at each position on the medium may be regulated not to exceed approximately 150% to 180%. This, however, may weaken the color tones of second-order colors to be expressed, failing to offer a colorful and vivid printing performance. While the inks ejected may be thus regulated, more inks may be eventually used to express the second-order colors than the ink amounts to express the first-order colors (100%). This approach may be inadequate to suppress the risk of ink bleeding when, for example, media of chemical fiber fabrics are used.

A range of ink bleeding (distance by which ink runs and spreads) is inversely proportional to the one-half power of ink viscosity. In this regard, high-viscosity ink may be favorably used to prevent the occurrence of ink bleeding.

The offset printing, unlike inkjet printing, uses inks having viscosities as high as several tens of thousands to hundreds of thousands of mPa·sec.

However, the inkjet printing is theoretically not allowed to use such high-viscosity inks. The upper limit of ink viscosity may be, at most, less than or equal to several tens of mPa·sec. In the case of inkjet heads used in high-resolution printing (for example, 600 dpi or more) required in recent years, the upper-limit viscosity of ink is increasingly lowered and should be now regulated to several tens of mPa·sec to several mPa·sec or even lower. The 4 color separation process, therefore, may increase the risk of ink bleeding with media of chemical fiber fabrics and may be inappropriate for a desired printing performance, as described earlier.

In this embodiment further using the R, G, and B color inks colors, the maximum amount of inks to express a second-order color may be reduced to an equal amount of inks to express a first-order color (100%). This may avoid the occurrence of ink bleeding at positions to be colored with the second-order colors when media of chemical fiber fabrics are used. In this embodiment, a colorful and vivid printing performance may be thus feasible in media of chemical fiber fabrics.

Figure 5A:
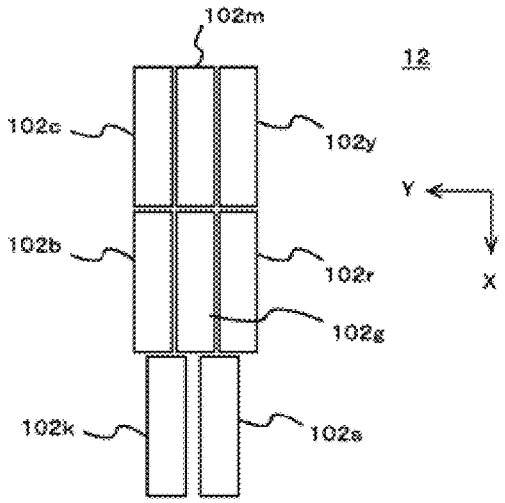
FIGS. 5A and 5B illustrate modified examples of the head portion.
Figure 5B:
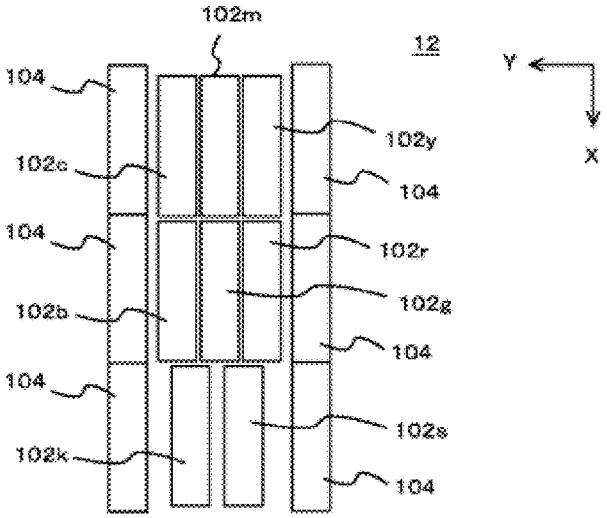

To more reliably suppress the risk of ink bleeding in the 7 color separation process, the inkjet heads may be arranged differently to the illustration of FIG. 1B. FIGS. 5A and 5B illustrate modified examples of the head portion 12. Except for the features described below, the structural elements illustrated in FIGS. 5A and 5B with the same reference signs as in FIGS. 1A to 4B may be identical or similar to the ones illustrated in FIGS. 1A to 4B.

FIG. 5A illustrates a modified example of the head portion 12. To prevent the occurrence of ink bleeding in inkjet printing, the amount of inks ejected to the same position in a main scan (pass) (amount of inks ejected to the same position at the same time) may be desirably reduced to minimum. To this end, some of the inkjet heads of the head portion 12 that possibly eject the inks to the same position may be displaced from the other inkjet heads in the sub scanning direction.

In the illustrated example, the inkjet heads 102*c-y* for Y, M, and C first-order colors are arranged in alignment next to one another in the main scanning direction (Y direction, Y axis), and the inkjet heads 102*r-b* for R, G, and B second-order colors are arranged in alignment next to one another in the main scanning direction at positions shifted from the inkjet heads 102*c-y* in the sub scanning direction (X direction). The inkjet head 102*k* for K third-order color is disposed at a position shifted from the inkjet heads 102*c-y* and 102*r-g* in the sub scanning direction. In FIG. 5B, an inkjet head 102*s* for spot color is used in addition to these inkjet heads. The inkjet head 102*s* is disposed alongside the inkjet head 102*k* in the main scanning direction. The spot color may be any color but the basic colors used in printing by the 7 color separation process (Y, M, C, R, G, B, and K). Examples of spot color ink may include white ink and orange ink.

This arrangement of the inkjet head may decrease the number of inkjet heads that eject the inks to the same position in the same main scan as compared to the arrangement in which the inkjet heads are all lined up in the main scanning direction. When the inks are ejected to the same position on the medium from the inkjet heads displaced from the other inkjet heads in the sub scanning direction, the ink of a color ejected from one of the inkjet heads may arrive at the position after the solvent in the ink ejected earlier to the medium from the other inkjet head (ink of another color) is dried to a certain extent. This may more reliably prevent the occurrence of ink bleeding.

Among the inkjet heads thus arranged, the inkjet heads 102*y-c* may be referred to as an array of first-order color heads, the inkjet heads 102*r-b* may be referred to as an array of second-order color heads, and the inkjet heads 102*k* and 102*s* may be referred to as an array of third-order and spot color heads.

In the head portion 12 having the inkjet heads thus arranged, color reproducibility may be further improved when, for example, main scans are performed in reciprocating motion in the main scanning direction (bi-directional printing). In the case all of the inkjet heads are arranged in alignment next to one another in the main scanning direction, for example, the order of color inks landing on the medium is decided by a current direction of movement of the head portion 12 during main scans. In the bi-directional printing, for example, the order of color inks landing on the medium is reversed between two directions in reciprocating motion of the inkjet heads. This may generate disparity, between two directions of a main scan, in color reproducibility of intermediate colors expressed by mixing different color inks.

In printing by the 7 color separation process, the second-order color inks are further used that are intermediate colors of the first-order colors. Therefore, neither of mixing the first-order color inks nor mixing the second-order color inks may be usually unnecessary. In the example illustrated in FIG. 5A, the inkjet heads respectively for first-order, second-order, and third-order colors are arranged by each color group at positions shifted in the sub scanning direction from the inkjet heads for the other color-orders. Therefore, it may become theoretically unnecessary to eject different color inks to the same position in the same main scan. This arrangement, when employed in the bi-directional printing, may prevent disparity in color reproducibility between two directions of a main scan, successfully offering a colorful and vivid printing performance.

When polyester fiber taffeta is used as print medium, as described earlier, a desired printing performance may be feasible at a printing speed and with a printing quality suitable for practical use by using the head portion 12 arranged as illustrated in FIG. 1B. The example illustrated in FIG. 5A may be considered more appropriate when higher precision or higher speed is required of printing.

To more reliably suppress the risk of ink bleeding, the head portion 12 or the printing apparatus 10 may be further modified, and/or inks more quickly dried may be used in the inkjet heads.

FIG. 5B illustrates a modified example of the head portion 12, in which quick-drying inks dried by being irradiated with an energy line (instantaneous drying inks) are used in the inkjet heads. Such ink contains an energy absorbent that absorbs the energy line to generate heat. By irradiating ink with the energy line having a predetermined wavelength, the ink per se generates heat and is thereby dried in short time.

A specific example of the energy line may be ultraviolet light. In this instance, ink containing an ultraviolet absorbent (UV instantaneous drying ink) is used, which is irradiated with ultraviolet light and dried. As illustrated in FIG. 5B, the head portion 12 further includes a plurality of ultraviolet irradiators 104. The ultraviolet irradiators 104 are disposed on one side and on the other side of an array of inkjet heads (head array) in the main scanning direction.

The ultraviolet irradiators thus arranged may irradiate ink that has just landed on the medium in each main scan with ultraviolet light to instantaneously dry the ink. The ink thus dried may certainly be difficult to bleed and run.

Examples of the ultraviolet irradiator 104 may include UVLED. The printing operation using the head portion 12 thus structured may be defined as UV instantaneous drying printing system. In other modified examples of the head portion 12 and the printing apparatus 10, other energy lines (for example, infrared light) may be used instead of ultraviolet light.

The head portion 12 structured as illustrated in FIGS. 5A and 5B may inevitably increase in width in the sub scanning direction, as compared to the head portion 12 illustrated in FIG. 1B. This may require the printing apparatus 10 to be structurally modified in accordance with an increased width of the head portion 12 in the sub scanning direction.

Figure 6:
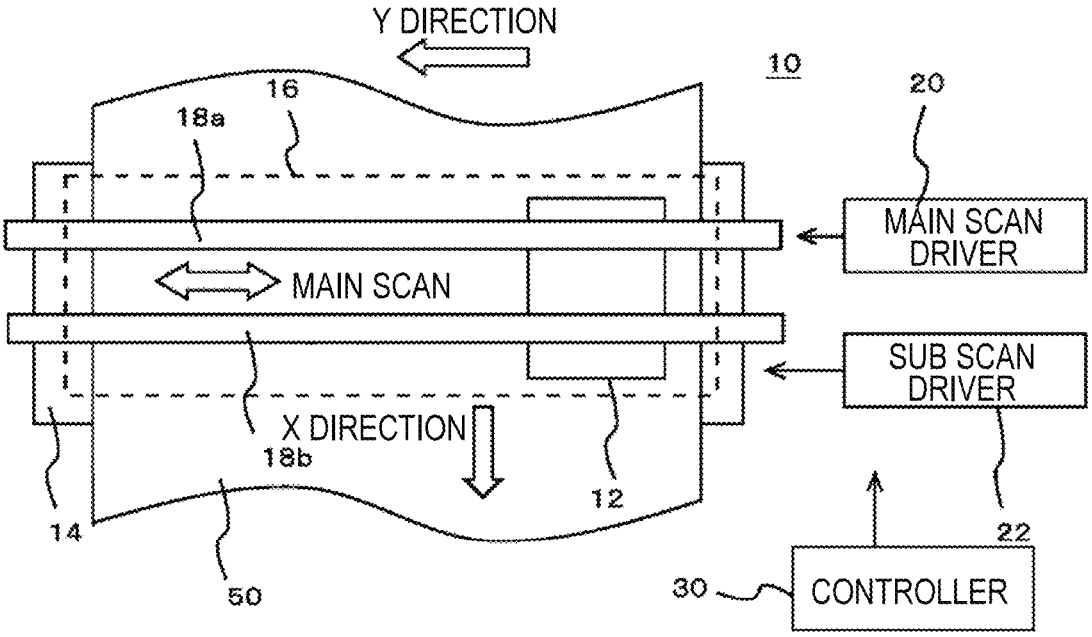
FIG. 6 illustrates a modified example of the printing apparatus.

FIG. 6 illustrates a modified example of the printing apparatus 10, in which a plurality of guide rails 18*a* and 18*b* are used. Except for the features described below, the structural elements illustrated in FIG. 6 with the same reference signs as in FIGS. 1A to 5B may be identical or similar to the ones illustrated in FIGS. 1A to 5B.

The guide rails 18*a* and 18*b* are displaced from each other in the sub scanning direction. The guide rails 18*a* and 18*b* guide, at the respective positions, the movement of the head portion 12 during main scans. The head portion 12, if increased in width in the sub scanning direction, may be precisely guided by these two guide rails.

In the illustrated example, the guide rail 18*a* is a main driving shaft, while the guide rail 18*b* is a driven shaft. The main driving shaft is a shaft member that guides the movement of the head portion 12 by feeding motive power for moving the head portion 12. The driven shaft is a shaft member that guides the movement of the head portion 12 driven to move by the main driving shaft. The guide rails 18*a* and 18*b* may also be used in the head portion 12 illustrated in FIG. 1B. Then, the head portion 12 of FIG. 1B may be precisely guided likewise by these guide rails during main scans.

In a modified example described below, the number of colors of inks to be used is further increased. The description given so far mostly focuses on printing by the 7 color separation process using seven color inks. Optionally, more color inks may be used to further decrease the ink amount per unit area. For example, inks having 2.5th-order colors may be further used, which are intermediate colors between first-order and second-order colors.

Figure 7A:
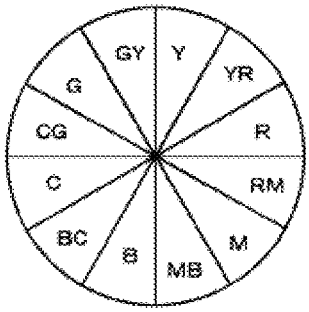
FIGS. 7A and 7B illustrate a modified example in which inks having 2.5th-order colors are further used.
Figure 7B:
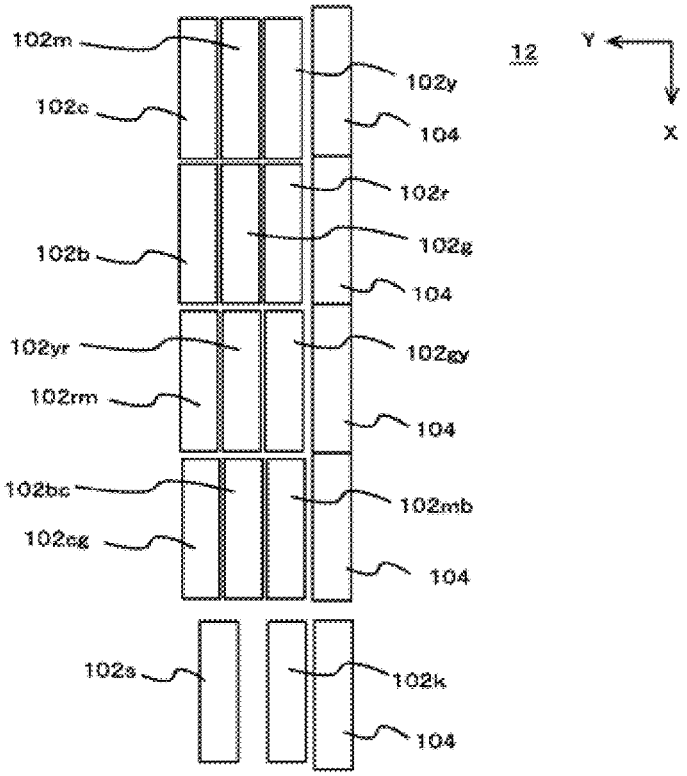

FIGS. 7A and 7B illustrate a modified example in which inks having 2.5th-order colors are further used. FIG. 7A illustrates a model that illustrates color correlation among colors of inks used in the modified example. In this modified example, 2.5th-order color inks hereinafter described are used in addition to the first-order color (Y, M, and C) inks and second-order color (R, G, and B) inks. Further, a color—amount (volume) relationship of inks used is strictly defined as described below.

In this modified example, the first-order colors are three primary colors Y, M, and C, and R, G, and B colors are directly used as second-order colors similarly to the 7 color separation process, instead of two first-order colors mixed in equal amount as in the 4 color separation process printing. Focusing on a second-order color among R, G, B (one color), the ink amount required to express the higher-order color is equal to the ink amount required to express a first-order color which is a lower-order color. The ink amount then is substantially one-half of the ink amount required to express a second-order color by mixing the first-order colors (total ink amount for first-order color mixing).

In a relationship between the first-order colors and the second-order colors, R color is a substantially intermediate color between Y color and M color. To express the second-order colors by color mixing, therefore, R color is obtained by mixing Y and M colors at the ratio of 1:1. Likewise, to express the second-order colors by color mixing, B color, which is a substantially intermediate color between M color and C color, is obtained by mixing M and C colors at the ratio of 1:1, and G color, which is a substantially intermediate color between C color and Y color, is obtained by mixing C and Y colors at the ratio of 1:1.

When the first-order colors and the second-order colors are arranged in accordance with the first-order and second-order color mixing relationship, the first-order colors and the second-order colors are arranged, as illustrated in FIG. 7A, so that a second-order color is interposed between two first-order colors mixable to express the second-order color. Referring to this figure, a color obtained by mixing two first-order and second-order colors next to each other at the ratio of 1:1 may be referred to as 2.5th-order color.

In FIG. 7A, for example, any colors but Y, M, C, R, G, and B colors are 2.5th-order colors. Among these colors, YR color is a substantially intermediate color between Y color and R color. When the 2.5th-order color is obtained by mixing the first-order and second-order colors, YR color is obtained by mixing Y and R colors at the ratio of 1:1. Likewise, RM color is a substantially intermediate color between R color and M color. When the 2.5th-order color is obtained by mixing the first-order and second-order colors, RM color is obtained by mixing R and M colors at the ratio of 1:1. Likewise, MB color is a substantially intermediate color between M color and B color. When the 2.5th-order color is obtained by mixing the first-order and second-order colors, MB color is obtained by mixing M and B colors at the ratio of 1:1. Likewise, BC color is a substantially intermediate color between B color and C color. When the 2.5th-order color is obtained by mixing the first-order and second-order colors, BC color is obtained by mixing B and C colors at the ratio of 1:1. Likewise, CG color is a substantially intermediate color between C color and G color. When the 2.5th-order color is obtained by mixing the first-order and second-order colors, CG color is obtained by mixing C and G colors at the ratio of 1:1. Likewise, GY color is a substantially intermediate color between G color and Y color. When the 2.5th-order color is obtained by mixing the first-order and second-order colors, GY color is obtained by mixing G and Y colors at the ratio of 1:1.

In this modified example, inks having 2.5th-order colors are used to directly express the 2.5th-order colors, instead of mixing different color inks. Assuming that "1" (100%) represents the maximum amount of lower-order color inks mixed to obtain a 2.5th-order color, the amount of ink of a 2.5th-order color which is a higher-order color, directly used to obtain a 2.5th-order color is substantially equal to the lower-order color ink amount and is substantially one-half of the total ink amount required to obtain a 2.5th-order color by color mixing.

When, among inks for practical use, a first color ink (ink A) and a second color ink (ink B) that differ in color are mixed in equal amount to obtain a third color ink (ink C), for example, the amount of ink C resulting from mixing of the inks A and B in equal amount and the printing concentration have a relationship expressed by $A+B \approx C$.

Assuming that the lower-order inks to be in the relationship are the inks A and B, a substantially equal concentration in color to that of the mixed inks may be obtained by directly using a 2.5th-order color ink in substantially equal amount to the amount of one of the mixed inks. The ink that achieves a substantially equal concentration to that of the mixed inks thus obtainable in substantially equal amount to the amount of one of the mixed inks is used as ink of a 2.5th-order color which is a higher-order color. The relationship between the ink amount and the concentration is applicable to the first-order and second-order colors. This relationship is also applicable to the 7 color separation process, as described referring to FIGS. 1A to 6. In this modified example, the third-order color is K color ink. The K color may be defined as an achromatic color obtained by mixing Y, M, and C colors at the ratio of 1:1:1.

In this modified example, the inkjet heads in the head portion 12 may be optionally arranged in separate arrays per color group. FIG. 7B illustrates an example of the head portion 12 in the modified example.

In the illustrated example, the inkjet heads 102*c-y* for first-order Y, M, and C colors are arranged in alignment next to one another in the main scanning direction, and the inkjet heads 102*r-b* for second-order R, G, and B colors are arranged in alignment next to one another in the main scanning direction at positions shifted from the inkjet heads 102*c-y* in the sub scanning direction (X direction). Six inkjet heads for 2.5th-order colors are divided into separate arrays and arranged in alignment next to one another. Further, inkjet heads 102*k* and 102*s* respectively for K third-order color and spot color are disposed at positions shifted in the sub scanning direction from the inkjet heads for first-order, second-order, and 2.5th-order colors.

Thus, groups of inkjet heads respectively for first-order colors, second-order colors, 2.5th-order colors, and for third-order colors are respectively arranged at positions shifted in the sub scanning direction from the other groups of inkjet heads, so that inks are not ejected to the same position in the same main scan from different groups of inkjet heads at once. This may adequately decrease the amount of inks ejected to the same position in each main scan. In this modified example, therefore, the risk of ink bleeding may be adequately reduced.

FIG. 7B illustrates the head portion 12 in which the instantaneous drying inks are used, as in the example described earlier referring to FIG. 5B. In this figure, the ultraviolet irradiators 104 are disposed on one side alone of the head portion 12 in the main scanning direction to simplify the illustration. In another modified example, the ultraviolet irradiators 104 may be disposed on both sides of the head portion 12 in the main scanning direction. When regular inks allowed to dry by evaporation are used instead of the instantaneous drying inks, the ultraviolet irradiators 104 may be unnecessary if ultraviolet radiation is not required of drying the used inks.

A further detailed description is hereinafter given to the maximum amount of inks ejectable to each position on the medium in the same main scan (maximum ink landing amount) when 2.5th-order color inks are further used. As in the examples described so far, when inks of two lower-order color inks (for example, first-order color inks) are replaced with one higher-order color ink (for example, second-order color or 2.5th-order color ink), an exact relationship needs to be defined and set between the ink amounts and printing concentrations of two or more lower-order color inks and one higher-order color ink to be replaced.

Specifically, concentrations in color of inks used and the maximum ink landing amount preferably have a relationship defined as in (a), (b), and (c).

(a) second-order color

Vr (max)=1 Vy+1 Vm=1 Vr
Vg (max)=1 Vc+1 Vy=1 Vg
Vb (max)=1 Vc+1 Vm=1 Vb (b) 2.5th-order color Vbc (max)=1 Vb+1 Vc=1 Vbc
Vmb (max)=1 Vm+1 Vb=1 Vmb
Van (max)=1 Vr+1 Vm=1 Vrm
Vcg (max)=1 Vc+1 Vg=1 Vcg
Vgy (max)=1 Vg+1 Vy=1 Vgy
Vyr (max)=1 Vy+1 Vr=1 Vyr (c) third-order color Vk (max)=1 Vc+1 Vm+1 Vc=1 Vk.

In these relationships, Vr (max) is the maximum ink amount V (max) for each color in solid printing (100% printing) illustrated with color-indicating alphabets. The amount of one of lower-order color inks mixed in equal amount and the amount of ink of a higher-order color may be, for example, equal in these relationships.

The maximum viscosity of ink ejectable from an inkjet head is as low as approximately 20 mPa·sec. When ink allowed to dry by evaporation is selected and used, instead of ink instantaneously dried (solidified) immediately after landing on the medium such as ultraviolet-curable ink (UV ink), the ink amount should be decreased to reduce the risk of possible ink bleeding until the ink is dried and fixed to the medium. This is why these relationships are preferably satisfied. Focusing on, for example, the first-order and second-order colors when inks satisfying the relationships are used, ink properties may be defined and set as follows; between two first-order color inks, among the Y, M, and C color inks, mixed to obtain a second-order color, and a second-order color ink directly used in place of the second-order color ink obtained by color mixing, the amount of the second-order color ink directly used, which is mostly low-viscosity liquid, is one-half of the summed amount of the two first-order color inks to be mixed. Further, the amount of inks of higher-order colors than the second-order colors is substantially equal to the amount of one of color inks to be mixed. For example, inks of multi-order colors may be used, for example, inks of a third-order color corresponding to a color obtained by mixing three first-order colors and of a 2.5th-order color corresponding to a color obtained by mixing the first-order and second-order colors. Such inks may be selectively used such that the maximum amount does not exceed the summed amount.

As for the first-order colors (Y, M, C) and third-order color (K) used in the 4 color separation process, first-order colors (Y, M, C), second-order colors (R, G, B), and third-order color (K) used in the 7 color separation process, and first-order colors (Y, M, C), second-order colors (R, G, B), 2.5th-order colors (for example, YR), and third-order color (K) used in the 13 color separation process using 13 colors including 2.5th-order colors, inks may be used, in which the maximum ink amount V (max)=1V=1 D and the maximum concentration D (max)=1 D have been adjusted.

As for the maximum ink concentrations D (max) of respective color inks in solid printing (100% printing), the concentration of one of two lower-order color inks mixed in equal amount and the concentration of a higher-order color ink are equal to each other, as in (a), (b), and (c).

(a) second-order color

Dr (max)=1 Dy+1 Dm=1 Dr
Dg (max)=1 Dc+1 Dy=1 Dg
Db (max)=1 Dc+1 Dm=1 Db (b) 2.5th-order color Dbc (max)=1 Db+1 Dc=1 Dbc Dmb (max)=1 Dm+1 Db=1 Dmb Dim (max)=1 Dr+1 Dm=1 Drm Dcg (max)=1 Dc+1 Dg=1 Dcg Dgy (max)=1 Dg+1 Dy=1 Dgy Dyr (max)=1 Dy+1 Dr=1 Dyr (c) third-order color Dk (max)=1 Dc+1 Dm+1 Dc=1 Dk.

As for the maximum ink concentrations D (max) of respective color inks in printing at α% (printing by 1α), the amount of one of two lower-order color inks mixed in equal amount and the amount of a higher-order color ink are equal to each other, as in (a), (b), and (c). The formulas below may be considered to represent relationships between the ink concentrations and the ink amounts (volumes) in printing by the ratio of α less than 1.

(a) second-order color

αVr (max)=αVy+αVm=αVr

αVg (max)=αVc+αVy=αVg

αVb (max)=αVc+αVm=αVb (b) 2.5th-order-order color

αVbc (max)=αVb+αVc=αVbc

αVmb (max)=αVm+αVb=αVmb

αVrm (max)=αVr+αVm=αVym

αVcg (max)=αVc+αVg=αVcg

αVgy (max)=αVg+αVy=αVgy

αVyr (max)=αVy+αVr=αVyr (c) third-order color

αVk (max)=αVc+αVm+αVc=αVk.

As for the maximum ink concentrations D (max) in printing by the ratio of a, the concentration of one of two lower-order color inks mixed in equal amount and the concentration of a higher-order color ink are equal to each other, as in (a), (b), and (c).

(a) second-order color

αDr (max)=αDy+αDm=αDr

αDg (max)=αDc+αDy=αDg

αDb (max)=αDc+αDm=αDb (b) 2.5th-order color

αDbc (max)=αDb+αDc=αDbc

αDmb (max)=αDm+αDb=αDmb

αDrm (max)=αDr+αDm=αDrm

αDcg (max)=αDc+αDg=αDcg

αDgy (max)=αDg+αDy=αDgy

αDyr (max)=αDy+αDr=αDyr (c) third-order color

αDk (max)=αDc+αDm+αDc=αDk.

Hereinafter are described in further detail reasons why the risk of ink bleeding may be reduced in the 7 color separation process or 13 color separation process. FIGS. 8A and 8B illustrate ink total amounts required to express variously different colors. FIG. 8A illustrates color examples that can be expressed in full-color printing. This figure shows ink amounts required in a 3 color separation process using Y, M, and C three primary colors alone to express colors illustrated in examples A to E. In this figure, ink amounts of the Y, M, and C color inks ejected per unit area are illustrated by the unit of vol. %.

FIG. 8B illustrates the amount of color inks required to express each of the colors in the examples A to E illustrated in FIG. 8A, and the total amount of inks ejected to the same position in each main scan when the number of printing colors and the arrangement of inkjet heads are variously changed. FIG. 8B shows, the amount of inks for each of the colors in the examples A to E required in the 3 color separation process, 4 color separation process, 7 color separation process, and 13 color separation process, and the total amount of inks ejected to the same position in each main scan. Further, this figure shows the ink total amounts in two different arrangements of the inkjet heads, which are aligned arrangement and per-color group arrangement.

The aligned arrangement means that all of the inkjet heads are arranged in alignment in the main scanning direction. The per-color group arrangement means that the inkjet heads in a color group alone are arranged in alignment next to one another in the main scanning direction, and the inkjet heads in a different color group are arranged in alignment next to one another at positions shifted from the other color group in the sub scanning direction. The inkjet heads in a color group alone being arranged in alignment next to one another in the main scanning direction may not necessarily mean that all of the inkjet heads in a color group are arranged in alignment but may mean that the inkjet heads in a color group are divided into a plurality of arrays and accordingly arranged.

In the 3 color separation process and the 4 color separation process, the per-color group arrangement means that the inkjet heads for different colors are divided per color and arranged at positions shifted from the other inkjet heads in the sub scanning direction, instead of all of the inkjet heads for different colors being arranged in alignment in the main scanning direction. In both of the 7 color separation process and the 13 color separation process, the per-color group arrangement means that the inkjet heads are arranged in different arrays per color group, as described earlier referring to, for example, FIGS. 5A, 5B and 7B. A large number of inkjet heads for the same color group, like the inkjet heads for 2.5th-order colors in the 13 color separation process, may be divided into a plurality of arrays, as illustrated in FIG. 7B.

As is known from the result of FIG. 8B, the 4 color separation process, as compared to the 7 color separation process, may decrease the ink total amounts to at most a half by only increasing the types of inks used. When, for example, inks of two colors selected from the Y, M, and C are ejected to 100%, resulting in the total amount of 200% in the 4 color separation process, the ink total amount may be decreased to 100% in the 7 color separation process.

As illustrated in the figures, the per-color group arrangement may be an effective configurations for reduction of the ink total amount. When, for example, the colors of A to E are expressed in the 4 color separation process using the aligned arrangement, at most all of the first-order color inks of Y, M, and C are ejected to the same position in the same main scan. To express any higher-order colors that can be expressed by combining lower-order colors either in either the 7 color separation process or the 13 color separation process, higher-order color inks are directly used instead of mixing lower-order color inks. It may be accordingly prevented that inks of two or more different colors, among colors of the same color group (first-order colors, second-order colors, 2.5th-order colors), are ejected to the same position in the same main scan.

The 7 color separation process and the 13 color separation process may accordingly decide positions of the inkjet heads in the per-color group arrangement. Thus, inks of two or more different colors, among colors of the same color group, may be prevented from being ejected to the same position in the same main scan. This may avoid increase of the total amount of inks ejected to the same position in the same main scan from the inkjet heads, if they are arranged in alignment in the main scanning direction (aligned on the Y axis) so as to pass through the same region in each main scan. In printing by the 7 color separation process or 13 color separation process, the ink total amount ejected to the same position in the same main scan may be decreased by employing the per-color group arrangement, instead of the aligned arrangement. This may more adequately suppress the occurrence of ink bleeding. Because of a reduced risk of ink bleeding, the printing speed may be increased, and a colorful and vivid printing performance may be feasible at a higher resolution.

For the purpose of reducing the risk of ink bleeding, color concentrations and the maximum ink landing amounts of lower-order color inks and higher-order color inks used for printing are preferably set so as to satisfy the relationships described with reference to the formulas. The inventor of this disclosure conducted various studies and tests, which convinces them that marked improvements are attainable by setting the ink amounts of lower-order color inks and higher-order color inks ejected to the same position in the same main scan to stay within a range of substantially 100±20-%. As is known from the result of FIG. 8B, in regular full-color image printing by the 7 color separation process, all of the colors may be substantially reproduced with the required ink total amount of 100% or less. Thus, a print result obtained by the 7 color separation process may exhibit a remarkable effect in the prevention of ink bleeding. Further, the occurrence of ink bleeding may be more adequately suppressed in the 13 color separation process in which a larger number of different color inks are used.

Through the tests, the inventor was convinced of an adequately reduced risk of ink bleeding achievable in the 7 color separation process using aqueous latex inks, inkjet heads of the aligned arrangement, and a heater set to approximately 40° C. to heat the medium 50, and with the number of printing passes being set to a practical number, approximately eight. The number of printing passes of 16 or more may completely prevent the occurrence of ink bleeding (no visible ink bleeding). The heating temperature of the heater being set to 50° C. may completely prevent the occurrence of ink bleeding, even with 8 printing passes. Under the same conditions as described above, ink bleeding was unacceptably heavy in the 4 color separation process, which was found to be inappropriate for printing.

In the 7 color separation process using the per-color group arrangement, the occurrence of ink bleeding may be completely prevented at the heater temperature of 40° C. and with 4 printing passes. This may confirm that combining the 7 color separation process and the per-color group arrangement of inkjet heads may allow for higher printing speeds.

Supplementary remarks are given below to the modified examples and the configurations disclosed herein. The 7 color separation process and 13 color separation process were so far described, in which more color inks for printing are used than in the 4 color separation process. In other modified examples of the printing apparatus 10, pale (light) color inks having weaker colors than the regular inks may be used for printing in addition to the seven color inks. Examples of such inks may include inks having pale colors of first-order, second-order, 2.5th-order, and third-order colors. With such additional color inks, midtones may be more distinctly expressed, and coarsened image texture may be avoidable. As a result, a colorful and vivid image may be successfully printed. The pale color inks may not be necessarily used for all of colors but may be used for part of the colors. For example, pale colors may be less needed for colors such as Y color and 2.5th-order colors approximate to Y color such as gy and yr colors. Therefore, pale color inks may be used for any colors but these colors, and may be unused for the K color which is an achromatic color.

In the 7 color separation process or 13 color separation process, various spot colors may be additionally used other than combinations of seven or 13 basic colors including first-order, second-order, 2.5th-order, and third-order colors, insofar as such basic colors required of these processes are certainly used. Examples of the spot colors may include white, metallic, fluorescent, clear, and orange colors. Another example of the spot color may be the color of a company logo. In the case such spot colors are used, inkjet heads for spot colors may be arranged on the Y axis in the main scanning direction next to the inkjet heads for one of the color groups (first-order, second-order, 2.5th-order, and third-order colors). The inkjet heads for spot colors may be disposed on another Y axis at positions shifted in the sub scanning direction from the inkjet heads for the other color groups.

The description given so far mostly focuses on the use of ink allowed to dry by evaporation. This ink may be dried by heating the medium using a heater. An example of the heater may be a printing heater that heats a medium at a position at which the heater faces the inkjet heads across the medium. A heater other than the printing heater may be used to improve the efficiency of drying the ink. Examples of the other heater may include a pre-heater that heats the medium at a position more upstream than the inkjet heads in the medium transport direction (preheating treatment), and an after-heater that heats the medium at a position more downstream than the inkjet heads in the medium transport direction (after-heating treatment).

As described earlier, a possible example of the ink allowed to dry by evaporation is a UV instantaneous drying ink containing an ultraviolet absorbent. Among the instantaneous drying inks of this type are inks instantaneously dried by being irradiated with other energy lines instead of ultraviolet light (for example, infrared ray, electric beam). In the case such an instantaneous drying ink is used, the printing apparatus 10 may further include (an) irradiating device that radiate an energy line adapted for properties of the ink.

So far were described the technical aspects and configurations when the medium of chemical fiber fabric and ink allowed to dry by evaporation are used for printing. The concept of this disclosure may be more generalized and applied to other media and inks to discuss the ink bleeding-preventive effect attained by the 7 color separation process and the per-color group arrangement of inkjet heads.

The description given so far mostly discussed the use of the latex ink. The 7 color separation process and per-color group arrangement of inkjet heads may be considered to more distinctly exert the ink bleeding-preventive effect when any inks likely to bleed are used in high-speed printing. In this regard, examples of usable inks may include variously different inks insofar as they can be ejected from inkjet heads. Specific examples of such inks may include aqueous inks, latex inks, solvent inks, solvent UV inks, and ultraviolet-curable inks, and may further include inks curable by electric beams.

The medium used is not necessarily limited to media of chemical fiber fabrics in terms of the ink bleeding-preventive effect attained by the 7 color separation process and the per-color group arrangement of inkjet heads. Such media may be, for example, media of various types conventionally difficult to be used for printing purposes because of greater risks of ink bleeding in the 4 color separation process. Specific examples of such media may include papers and fabrics in which solvents in inks are easily absorbable. Particular examples may include media with no coating film for ink-absorbed layers (image-formed layers) or subjected to no pretreatment as a preventive measure against ink bleeding. These media may be suitably used with a reduced risk of ink bleeding by employing the 7 color separation process and per-color group arrangement of inkjet heads. In view of the ink bleeding-preventive effect, the usable range of media may be broadened to include media with a coating film for ink-absorbed layers (image-formed layer) or subjected to necessary pretreatment as a preventive measure against ink bleeding. The medium may be subjected to various post-treatment processes.

Considering the expected effects of the 7 color separation process and per-color group arrangement of inkjet heads in view of all of the possible options described so far, the printing speed may be at least approximately three to four times higher than in the conventional 4 color separation process. When the per-color group arrangement of inkjet heads is employed in bi-directional printing in which main scans in reciprocating motion are performed (printing in both directions), the landing order of color inks at the same position (same spot) does not change with different directions of the movement of the inkjet heads during main scans. Then, a colorful and vivid printing performance that can only be conventionally possible with uni-directional main scans (printing in one direction) may be feasible with main scans in reciprocating motion. As a result, higher printing speeds and a colorful and vivid printing performance may be both successfully achieved.

When the ink allowed to dry by evaporation used is a UV instantaneous drying ink with a reduced risk of ink bleeding, the printing speed may be further increased. In that case, the printing speed may be approximately 10 times higher than in the conventional 4 color separation process, and any energy required of ink drying (power consumption) may be decreased as compared to the use of a heater for ink drying. Then, required power may be reduced to at least less than a half, as compared to the use of a heater such as a printing heater for ink drying. Thus, energy saving of the printing apparatus 10 may certainly be possible.

INDUSTRIAL APPLICABILITY

The technology disclosed herein may be suitably applicable to printing apparatuses.

What is claimed is:

1. A printing apparatus for printing a print target on a medium including chemical fiber fabric, the printing apparatus comprising:

a plurality of chromatic color heads which are inkjet heads that eject inks having chromatic colors; and a black color head which is an inkjet head that ejects ink having black color, wherein the inks ejected from the plurality of chromatic color heads and the black color head being allowed to dry by evaporation and each ink comprising a solvent and a coloring material for expressing a color of the ink, and the inks being dried by evaporating the solvents in the inks to be fixed to the medium, the plurality of chromatic color heads comprising at least six or more inkjet heads that respectively eject the inks having chromatic colors distinct from each other, the plurality of chromatic color heads comprise, at least:

inkjet heads for first-order colors which are basic colors that theoretically allow full colors to be expressed by color mixing;

inkjet heads for second-order colors which are colors obtained by mixing two colors selected from the first-order colors, the inkjet heads for first-order colors comprise, at least:

an inkjet head that ejects ink having yellow color;

an inkjet head that ejects ink having magenta color; and an inkjet head that ejects ink having cyan color, the inkjet heads for second-order colors comprise, at least:

an inkjet head that ejects ink having red color;

an inkjet head that ejects ink having green color; and an inkjet head that ejects ink having blue color, a color obtained by mixing the inks having two colors selected from the first-order colors in equal amount is theoretically equal to and replaceable with the color of any one of the inks having the second-order colors in an amount equivalent to the equal amount, and when the ink having the black color ejected from the black color head is assumed to be ink having a third-order color, a color obtained by mixing all of the inks having the first-order colors in equal amount is theoretically equal to and replaceable with the color of the ink having the third-order color in an amount equivalent to the equal amount, the medium including the chemical fiber fabric, as compared to a medium including a natural fiber fabric, has a smaller absorbability with respect to the inks having chromatic colors and the inks having black color, and the inks having chromatic colors and the inks having black color landed on the medium are easier to spread, and a maximum amount of inks to express the second-order color or the third-order color is equal to an amount of inks to express the first-order color.

2. The printing apparatus according to claim 1, further comprising:

a main scan driver that causes the plurality of chromatic color heads and the black color head to perform main scans in which the plurality of chromatic color heads and the black color head eject the inks to the medium while moving in a main scanning direction previously set; and a sub scan driver that causes the plurality of chromatic color heads and the black color head to perform sub scans in which the plurality of chromatic color heads and the black color head move relative to the medium in a sub scanning direction orthogonal to the main scanning direction.

3. The printing apparatus according to claim 1, further comprising:

a main scan driver that causes the plurality of chromatic color heads and the black color head to perform main scans in which the plurality of chromatic color heads and the black color head eject the inks to the medium while moving in a main scanning direction previously set; and a sub scan driver that causes the plurality of chromatic color heads and the black color head to perform sub scans in which the plurality of chromatic color heads and the black color head move relative to the medium in a sub scanning direction orthogonal to the main scanning direction.

4. The printing apparatus according to claim 1, wherein the medium including fabric is a medium including polyester fiber fabric.

5. The printing apparatus according to claim 1, wherein the medium including fabric is a medium including taffeta.

6. The printing apparatus according to claim 1, wherein the medium including fabric is a medium including tropical fabric.

7. The printing apparatus according to claim 1, wherein the inks are latex inks.

8. The printing apparatus according to claim 1, further comprising:

a heater that heats the medium, wherein the heater heats the medium at temperatures lower than or equal to 50° C.

9. The printing apparatus according to claim 1, wherein the print target is printed on the medium without the use of a heater that heats the medium.

10. The printing apparatus according to claim 1, wherein the inks each include a pigment as the coloring material.

11. The printing apparatus according to claim 1, wherein the print target is printed on the medium to produce a printed matter installable outdoors.

12. The printing apparatus according to claim 11, wherein the printed matter installable outdoors is a banner.

13. The printing apparatus according to claim 1, wherein the inks having chromatic colors and the inks having black color are inks containing an energy absorbent that absorbs an energy line to generate heat, and the printing apparatus further comprises an energy line irradiating device which irradiates the energy line.

14. The printing apparatus according to claim 1, wherein the chromatic color heads are arranged in different arrays per color group in a sub-scanning direction orthogonal to the main scanning direction.

15. A printing method for printing a print target on a medium including chemical fiber fabric, the printing method comprising the use of:

a plurality of chromatic color heads which are inkjet heads that eject inks having chromatic colors; and a black color head which is an inkjet head that ejects ink having black color, wherein the inks ejected from the plurality of chromatic color heads and the black color head being inks allowed to dry by evaporation and each ink comprising a solvent and a coloring material for expressing a color of the ink, and the inks being dried by evaporating the solvents in the inks to be fixed to the medium, the plurality of chromatic color heads comprising at least six or more inkjet heads that respectively eject the inks having chromatic colors distinct from each other, the plurality of chromatic color heads comprise, at least:

inkjet heads for first-order colors which are basic colors that theoretically allow full colors to be expressed by color mixing;

inkjet heads for second-order colors which are colors obtained by mixing two colors selected from the first-order colors, the inkjet heads for first-order colors comprise, at least:

an inkjet head that ejects ink having yellow color;

an inkjet head that ejects ink having magenta color; and an inkjet head that ejects ink having cyan color, the inkjet heads for second-order colors comprise, at least:

an inkjet head that ejects ink having red color;

an inkjet head that ejects ink having green color; and an inkjet head that ejects ink having blue color, a color obtained by mixing the inks having two colors selected from the first-order colors in equal amount is theoretically equal to and replaceable with the color of any one of the inks having the second-order colors in an amount equivalent to the equal amount, and when the ink having the black color ejected from the black color head is assumed to be ink having a third-order color, a color obtained by mixing all of the inks having the first-order colors in equal amount is theoretically equal to and replaceable with the color of the ink having the third-order color in an amount equivalent to the equal amount, the medium including the chemical fiber fabric, as compared to a medium including a natural fiber fabric, has a smaller absorbability with respect to the inks having chromatic colors and the inks having black color, and the inks having chromatic colors and the inks having black color landed on the medium are easier to spread, and a maximum amount of inks to express the second-order color or the third-order color is equal to an amount of inks to express the first-order color.

* * * * *